US006505589B1

(12) United States Patent
Hayman et al.

(10) Patent No.: US 6,505,589 B1
(45) Date of Patent: Jan. 14, 2003

(54) SINGLE CAM THREE-VALVE ENGINE OVERHEAD VALVE TRAIN

(75) Inventors: Alan William Hayman, Romeo, MI (US); James Joseph Mazzola, III, Dryden, MI (US); Frederick J. Rozario, Fenton, MI (US); Terry Wayne Black, Clarkston, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/061,684

(22) Filed: Feb. 1, 2002

(51) Int. Cl.[7] ..... F01L 1/26

(52) U.S. Cl. ..... 123/90.23; 123/90.39; 123/90.61

(58) Field of Search ..... 123/90.22, 90.23, 123/90.39–90.47, 90.61–90.64

(56) References Cited

U.S. PATENT DOCUMENTS 4,519,364 A * 5/1985 Enomoto et al. ..... 123/432
4,649,874 A * 3/1987 Sonoda et al. ..... 123/90.36
5,253,620 A * 10/1993 Dohn et al. ..... 123/90.16
5,398,649 A * 3/1995 Shimamoto ..... 123/90.23
6,205,966 B1 * 3/2001 Breitenberger ..... 123/90.23

* cited by examiner

*Primary Examiner*—Weilun Lo
(74) *Attorney, Agent, or Firm*—Leslie C. Hodges

(57) ABSTRACT

A valve train layout for an overhead valve engine uses a single camshaft actuating two inlet valves and a single exhaust valve. The two inlet valves are preferably aligned on an inner side of a cylinder with the exhaust valve on an outer side. The inlet valves are preferably actuated by a cam follower and single push rod driving a rocker arm with dual arms and separate lash adjusters actuating the inlet valves. The exhaust valve is preferably actuated by a cam follower with a lash adjuster driving a single push rod operating a primary rocker arm that drives a secondary push rod pivoting an exhaust rocker arm to actuate the exhaust valve. In one embodiment, the primary rocker arm for the exhaust valve pivots on a common axis with the intake rocker arm. In an alternative embodiment, the primary rocker arm pivots on a canted pivot axis.

9 Claims, 3 Drawing Sheets

SINGLE CAM THREE-VALVE ENGINE OVERHEAD VALVE TRAIN

TECHNICAL FIELD

This invention relates to valve trains for overhead valve engines and, in particular, to efficient valve trains for engines having three valves per cylinder.

BACKGROUND OF THE INVENTION

Internal combustion engines have been provided with numerous types of valve configurations, commonly including two, three or four valves. The valves are configured to obtain desirable gas flow, compression and combustion results while providing simplicity of the valve train to the extent possible for the particular engine arrangement. The most simple valve arrangements have generally involved a single intake valve and a single exhaust valve actuated by an overhead valve train including a single camshaft with cam followers and push rods actuating rocker arms of an overhead valve train. For obtaining higher engine outputs, valve configurations with four valves per cylinder have become common, utilizing dual intake valves on one side of the cylinder, usually the inside and dual exhaust valves on the other, outside, of the cylinder. Such valve configurations are more commonly actuated by multiple overhead camshafts directly driving the valves, or by a single overhead camshaft per cylinder bank driving some of the valves directly and others through finger followers or other rocker mechanisms.

An alternative valve configuration utilizes three valves per cylinder, generally including dual intake valves disposed along an inner side of the cylinder and a single exhaust valve located toward an outer side of the cylinder. Valves of this type may be actuated by overhead camshafts. Alternatively, a single camshaft per engine may connect through cam followers and push rods with rocker arms which actuate the various valves. The valve trains for such cylinder configurations vary in complexity and efficiency as do the valve arrangements themselves, and the relative placement of an igniter such as a spark plug and, if used, a fuel injector for the cylinder.

SUMMARY OF THE INVENTION

The present invention provides a valve train layout for an overhead valve (OHV) engine which uses a single camshaft in the cylinder block. A combustion chamber is provided for each cylinder which utilizes two inlet valves and a single exhaust valve. The two inlet valves may, as desired, be of equal or differing diameters. They are longitudinally aligned on the inner side of the cylinder (or combustion chamber) and are symmetrically located on opposite sides of a lateral plane through the cylinder axis and extending normal to the axis of the engine crankshaft and camshaft.

The single exhaust valve may be located either on the lateral plane or asymmetric to one side of the plane, depending on the requirements of the combustion system. Preferably, the exhaust valve is displaced to one side of the lateral plane and along the outer side of the cylinder and is inclined at a compound angle relative to the lower face of the cylinder head and the associated mounting deck of the engine cylinder block.

The inlet valves are preferably actuated by a cam follower and single push rod driving a rocker arm with dual arms carrying separate lash adjusters for actuating the two inlet valves. The exhaust valve is preferably actuated by a cam follower with a lash adjuster driving a single push rod operating a primary, or slave, rocker arm which in turn drives a secondary push rod actuating an exhaust rocker arm that opens the exhaust valve. Conventional springs are provided to close the valves and maintain the cam followers in contact with their cams.

In one embodiment, the primary or slave rocker arm for the exhaust valve is pivotable on a common axis with the intake rocker arm. In an alternative embodiment, the primary or slave rocker arm is pivotable on a canted pivot axis. In each case, a secondary push rod drives an exhaust rocker arm pivotable on a canted axis to engage the exhaust valve while pivoting in a plane common to the valve axis. In either embodiment, the camshaft may if desired be controlled by a cam phaser for varying valve timing.

Both embodiments for an overhead valve engine provide improved inlet port flow for better specific power output and dynamic range through the use of the two inlet valves. Improved exhaust port flow is obtained due to the compound angle of the exhaust valve. Better catalytic converter performance is obtained due to the reduced heat loss compared to a system with two or more exhaust valves. The compound angle of the exhaust valve also permits a larger exhaust valve for a given cylinder bore size. The space occupied by of the upper portion of the engine is reduced significantly over a multi-valve engine with overhead camshafts.

Hydraulic lash adjusters may be provided for all three valves in the engine layout although mechanical lash adjustment could be used if desired. With a camshaft phaser, the inlet and exhaust timing may be adjusted for better performance. A potential for reduced hydrocarbon emissions is possible due to reduced crevice volume associated with the single exhaust valve as opposed to dual exhaust valves in four-valve engines. The invention provides valve train driving inlet and exhaust valves on substantially different axes without using common rocker shafts that have longer, less desirable, rocker arm arrangements. Finally, a simple cam drive for a multi-valve engine cylinder concept is provided which allows improved cylinder head water jacket geometries and better cylinder head cooling performance.

These and other features and advantages of the invention will be more fully understood from the following description of certain specific embodiments of the invention taken together with the accompanying drawings.

DESCRIPTION OF THE PREFERRED EMBODIMENT

Figure 1:
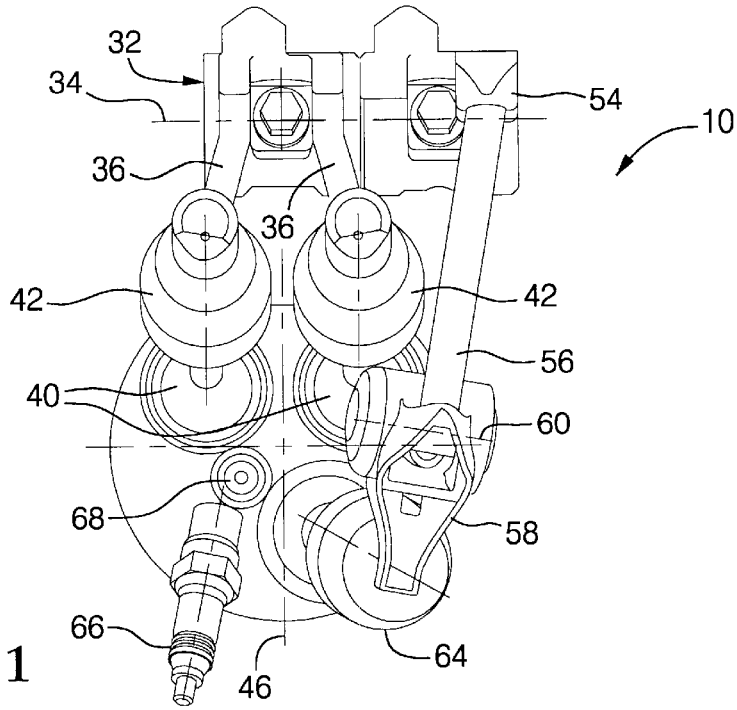
FIG. 1 is a plan view of a single cylinder bank of an engine showing a first embodiment of valve train according to the invention.
Figure 2:
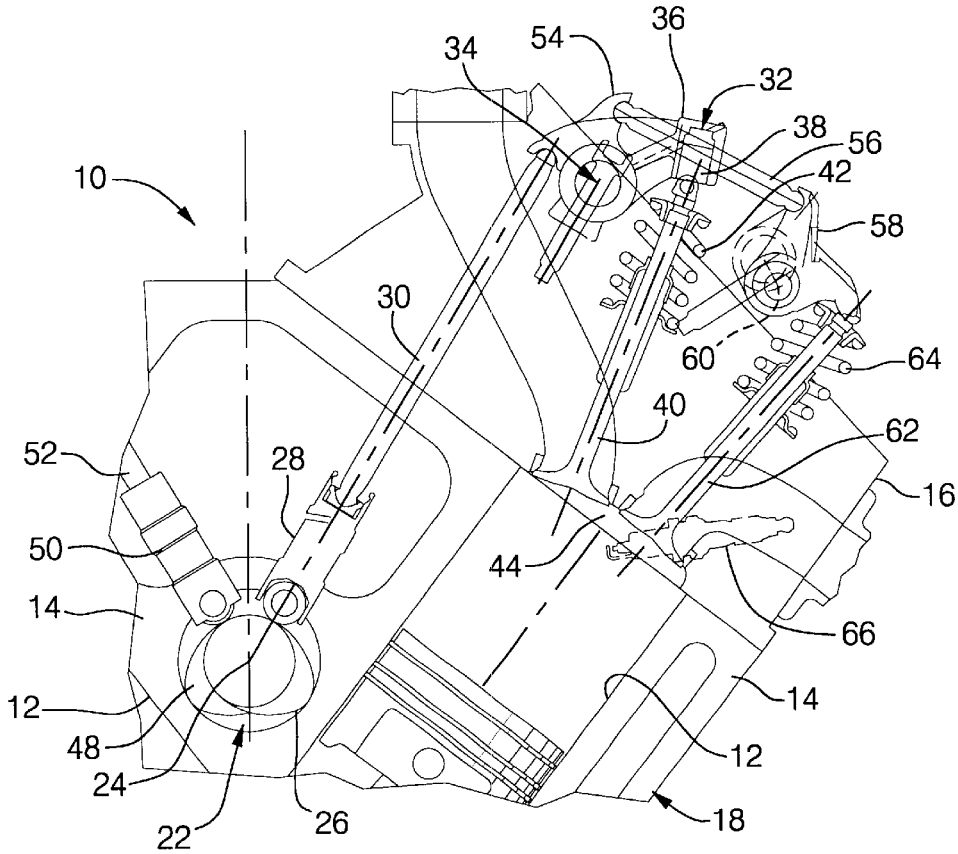
FIG. 2 is a transverse cross-sectional view of a portion of the engine of FIG. 1 further illustrating the valve train embodiment.
Figure 3:
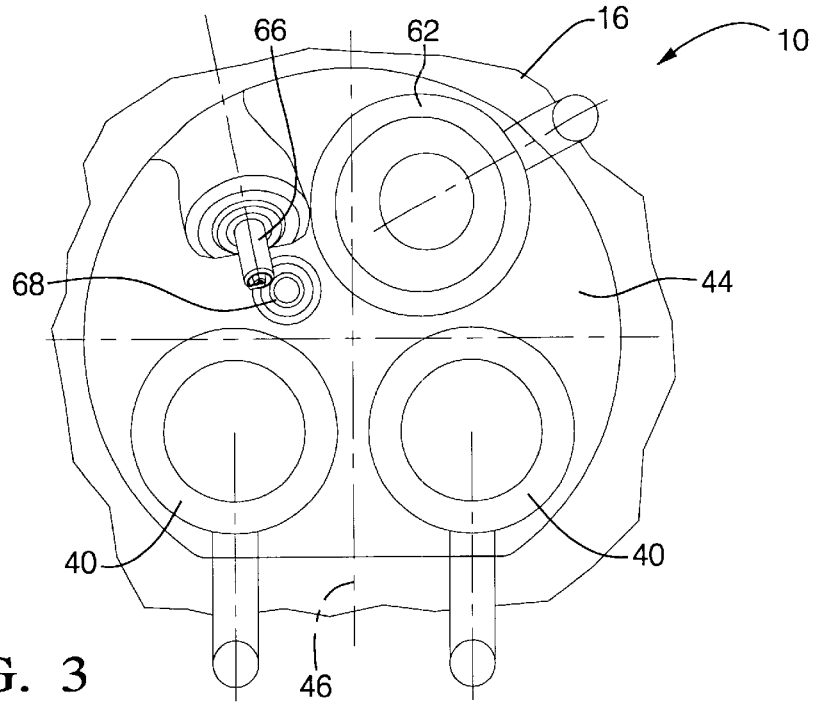
FIG. 3 is a bottom view of the cylinder head of FIG. 1 showing the internal combustion chamber arrangement and valve locations.

Referring first to FIGS. 1–3 of the drawing in detail, numeral generally indicates an internal combustion engine having a plurality of cylinders 12, only one of which is shown. The cylinders 12 are conventionally arranged in cylinder banks 14 with the upper ends of the cylinders being closed by cylinder heads 16.

The engine includes a cylinder block 18 supporting a crankshaft, not shown, which drives a camshaft 22 having a longitudinal axis extending parallel to the crankshaft axis, not shown. In a V-type engine, as shown, the camshaft 22 is located at the bottom of a V between the cylinder banks 14. FIGS. 1–3 illustrate the valve train arrangement in a single cylinder bank on one side of the engine and FIG. 2 additionally illustrates a portion of the valve train for a cylinder on the opposite cylinder bank 14 of the engine.

The valve train components include the camshaft 22 having a plurality of inlet cams 26. When rotated, each cam 26 reciprocates at least one inlet cam follower 28 connected with a push rod 30. The push rod actuates an inlet rocker arm 32 that rocks on a pivot axis 34 parallel to the camshaft axis 24. Rocker arm 32 includes a pair of actuating arms 36 each of which preferably carries a hydraulic lash adjuster 38. The lash adjusters engage a pair of inlet valves 40, each having a valve spring 42 for closing the respective valve and holding the cam follower 28 against the inlet cam 26. The inlet valves 40 are longitudinally aligned on the inner side of the cylinder and its associated combustion chamber 44 and are symmetrically located on opposite sides of a central lateral plane 46 extending normal to the crankshaft and camshaft axes and passing through the central axis, not shown, of the cylinder.

The camshaft 22 also carries a plurality of exhaust cams 48, only one of which is shown. Each exhaust cam actuates at least one cam follower 50 connecting with an exhaust push rod 52 for actuating a primary rocker arm or slave rocker arm 54 which in this embodiment is pivotable on the same pivot axis 34 as the inlet rocker arm 32. The cam follower and push rod for the rocker arm 54 illustrated are hidden in the drawing but are identical to the cam follower 50 and push rod 52 shown for actuating an exhaust valve in the opposite cylinder bank. The exhaust cam follower 50 preferably includes an internal hydraulic lash adjuster for adjusting the lash in the exhaust valve train driven by the follower.

The primary rocker arm 54 in turn engages a secondary push rod 56 which extends laterally at a slight longitudinally inward angle to engagement with a secondary rocker arm 58 pivotable on a canted axis 60. An actuating arm of rocker arm 58 directly engages the single exhaust valve 62 for its respective cylinder which includes a valve return spring 64 functioning as do the inlet valve springs to close the valve.

The exhaust valve may be located as desired on the outer side of the cylinder but as shown is desirably located asymmetrically longitudinally offset to one side of the cylinder, that is to one side of the central lateral plane 46. The exhaust valve 62 is angled at a compound angle with its axis directed generally toward the axis of the cylinder to provide a minimum crevice volume within the cylinder. Preferably, the rocking plane of the secondary rocker arm 58 where it contacts the exhaust valve 62 lies coplanar with the axis of the exhaust valve.

Spaced longitudinally on the other end of the outside of the cylinder from the exhaust valve location is an igniter in the form of a spark plug 66 or similar device. A fuel injector 68 may also be located at a position inwardly adjacent to the spark plug when the engine is provided with direct cylinder injection. However, the same cylinder configuration absent the direct fuel injector may also be utilized for an engine having manifold injection of the fuel.

In operation, rotation of the camshaft 24 during engine operation actuates the intake and exhaust valves in timed relation in accordance with predetermined valve lift diagrams. Actuation of the inlet cam follower 28 raises the push rod 30, pivoting the rocker arm 32 and opening both inlet valves 40 at the same time to provide a maximum amount of intake air flow. The separate lash adjusters at the ends of the actuating arms 36 of the rocker arm are required to separately adjust the lash of the two individual valves when driven by a single cam follower and push rod. If desired, the intake valves could be of differing sizes and could be driven by separate rocker arms actuated by individual push rods and cam followers from separate inlet cams in order to obtain a desired pattern of air flow within the cylinder. The general locations of the inlet valves being more or less symmetrical on the inner sides of the cylinder could remain the same.

Rotation of the camshaft 24 actuating the exhaust cam follower 50 with its integral lash adjuster raises the push rod 52 to actuate the primary rocker arm 54, secondary push rod 56 and secondary rocker arm 58 which opens the exhaust valve 62. Upon further rotation, the exhaust valve 62 is closed by the valve spring 64. Injection of fuel and ignition by the spark plug 66 will occur conventionally after compression of an air charge admitted through the intake valves with combustion and exhaust of the burned fuel-air charge following in conventional fashion.

Figure 4:
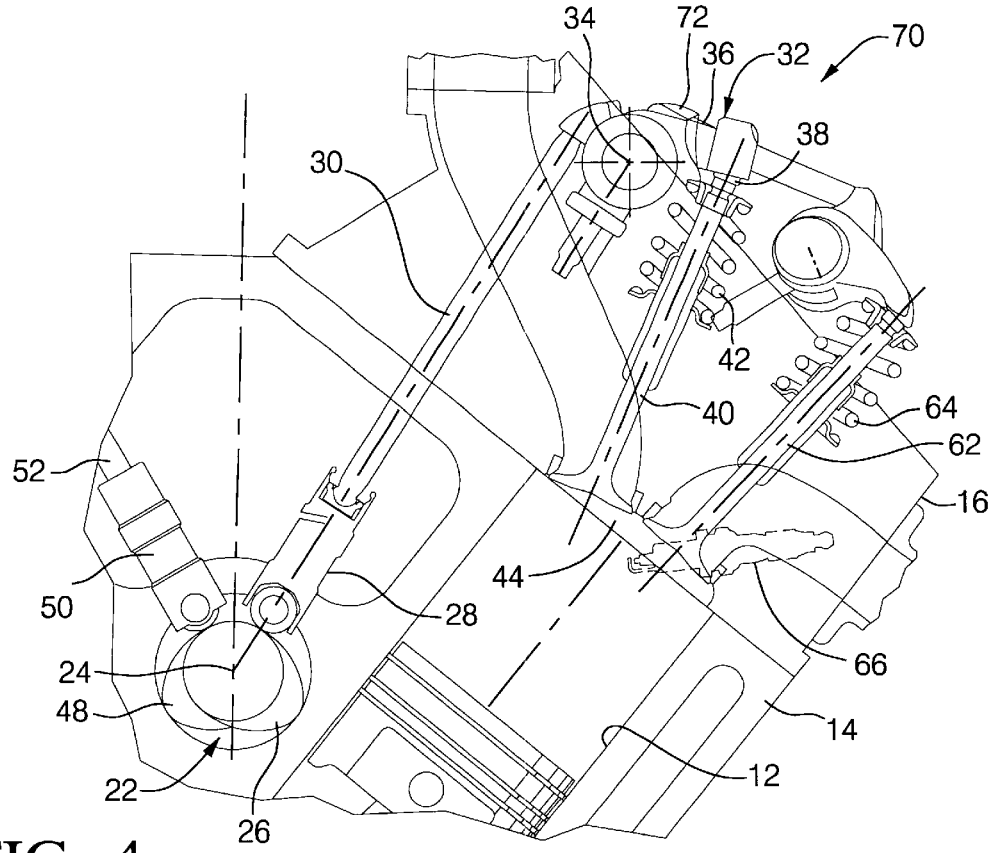
FIG. 4 is a view similar to FIG. 2 showing an alternative embodiment of a valve train according to the invention.
Figure 5:
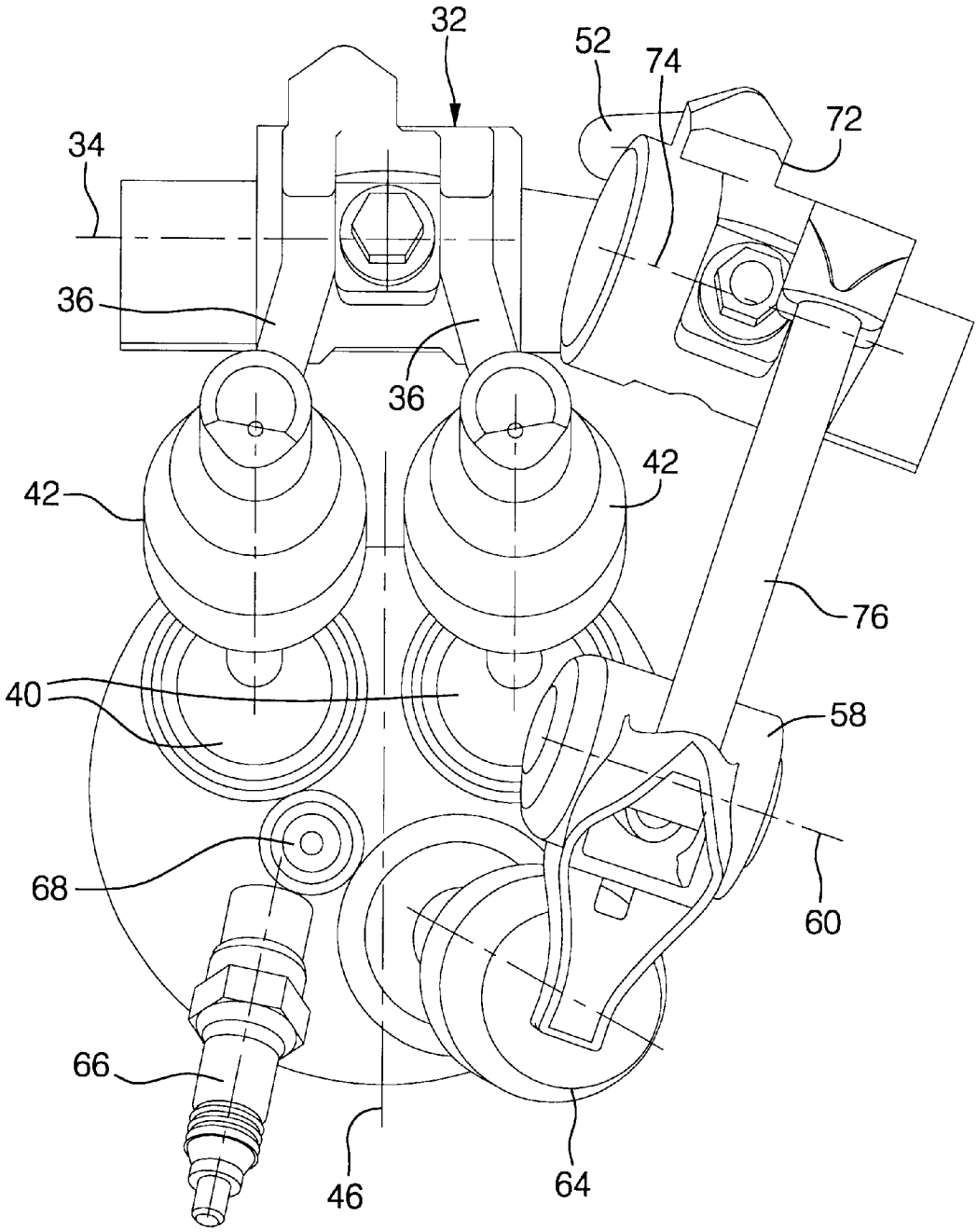
FIG. 5 is a view similar to FIG. 1 showing the alternative embodiment of FIG. 4.

FIGS. 4 and 5 illustrate an alternative embodiment similar to but modified from the embodiment of FIGS. 1–3 and wherein like numerals indicate like parts. Thus, engine 70 of FIGS. 4 and 5 includes a camshaft 22 and intake valve train like that of the first described embodiment. This alternative embodiment differs in that the slave rocker or primary exhaust rocker arm 72 is positioned on a canted axis 74 lying essentially parallel to the canted axis 60 of the secondary rocker arm 58. The two rocker arms are connected by a secondary push rod 76 essentially as before. As a result of repositioning the primary rocker arm 72, the exhaust primary push rod 52 and its connected follower 50 are also canted slightly from engagement of the follower with the exhaust cam 48 up to engagement of the push rod with the primary rocker arm 72. The configuration of the exhaust valve 62 and its valve spring 64 and the position of the spark plug 66 and the fuel injector 68, if used, are essentially the same as in the first described embodiment. Thus, the primary advantage of the second embodiment of FIGS. 4 and 5 is a more direct application of forces between the primary and secondary rocker arms due to the slight canting of the exhaust follower and push rod and the provision of a canted rocker arm pivot for the primary rocker arm.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A valve train for a three-valve-per-cylinder engine, said valve train comprising:

a single camshaft extending longitudinally along a cylinder bank of the engine, the camshaft including at least one inlet cam and one exhaust cam for each engine cylinder;

at least one inlet cam follower engaging each of the inlet cams and an exhaust cam follower engaging each of the exhaust cams;

an inlet pushrod connecting each inlet cam follower with an inlet rocker arm;

a first exhaust pushrod connecting each exhaust cam follower with a first exhaust rocker arm;

a second exhaust pushrod connecting each first exhaust rocker arm with a second exhaust rocker arm; and each inlet rocker arm operatively engaging at least one inlet valve for actuating the inlet valve and each second exhaust rocker arm operatively engaging at least one exhaust valve for actuating the exhaust valve.

2. A valve train as in claim 1 wherein each cylinder has dual inlet valves and a single exhaust valve.

3. A valve train as in claim 2 wherein said inlet valves are aligned longitudinally adjacent an inner side of the cylinder and the single exhaust valve is located adjacent an outer side of the cylinder.

4. A valve train as in claim 3 wherein said dual inlet valves are actuated by a single inlet rocker arm.

5. A valve train as in claim 4 wherein said second exhaust pushrod extends generally laterally across said cylinder between the first and second exhaust rocker arms to actuate said single exhaust valve.

6. A valve train as in claim 5 wherein said exhaust valve is offset longitudinally toward one side of the cylinder and an igniter is disposed longitudinally from the exhaust valve toward an opposite side of the cylinder.

7. A valve train as in claim 6 wherein a fuel injector is disposed adjacent the igniter in said opposite side of the cylinder.

8. A valve train as in claim 5 wherein said inlet rocker arm and said first exhaust rocker arm are pivotable on a common axis.

9. A valve train as in claim 5 wherein said inlet rocker arm and said first exhaust rocker arm are pivotable on non-parallel axes.

* * * * *